US007469445B2

(12) United States Patent
Dennis et al.

(10) Patent No.: US 7,469,445 B2
(45) Date of Patent: Dec. 30, 2008

(54) ADJUSTABLE BUMPER FOR DOOR

(75) Inventors: Robert P. Dennis, Royal Oak, MI (US); James B. Harmon, Bowling Green, KY (US)

(73) Assignee: GM Global Technology Operations, Inc., Detroit, MI (US)

( * ) Notice: Subject to any disclaimer, the term of this patent is extended or adjusted under 35 U.S.C. 154(b) by 561 days.

(21) Appl. No.: 11/167,997

(22) Filed: Jun. 28, 2005

(65) Prior Publication Data

US 2006/0288528 A1 Dec. 28, 2006

(51) Int. Cl.
*E05F 5/00* (2006.01)

(52) U.S. Cl. ..... 16/86 R; 16/82; 411/247

(58) Field of Classification Search ..... 16/82, 16/85, 86 R, DIG. 21, 6, 86 A, 86 B, 86 C; 411/310, 311, 301, 409, 249, 247
See application file for complete search history.

(56) References Cited

U.S. PATENT DOCUMENTS 308,887 A * 12/1884 Forg ..... 292/74
941,782 A * 11/1909 Hubbard ..... 292/74
1,383,582 A * 7/1921 Stubbs ..... 16/85
2,885,237 A * 5/1959 Heyer ..... 292/70
3,137,026 A * 6/1964 Flam ..... 16/85
4,653,968 A * 3/1987 Rapata et al. ..... 411/247
5,241,725 A * 9/1993 Hamatani et al. ..... 16/82
5,385,439 A * 1/1995 Hurdle ..... 411/386
5,689,853 A * 11/1997 Lemmer ..... 16/82
6,318,795 B1 * 11/2001 Pyo ..... 296/207
6,507,976 B2 * 1/2003 Ichimaru ..... 16/82
6,588,809 B1 * 7/2003 Derman ..... 292/129
6,629,335 B1 * 10/2003 Derman ..... 16/85

* cited by examiner

*Primary Examiner*—William L. Miller

(57) ABSTRACT

A vehicle instrument panel includes a glove box opening defined by a door frame, and a door hinged to the door frame. A threaded aperture is formed in the door frame. A one-piece elastomeric bumper has a threaded shank that threads into the threaded aperture to mount the bumper. The bumper has an abutment face that engages the door to establish a closed position of the door. Rotation of the threaded bumper advances or withdraws the abutment face so that the closed position is adjusted. A detent acts between the door frame and the bumper to retain the bumper at a selected rotary position, with the detent being released when the threaded shank of the bumper is stretched axially. A grip is molded into the bumper to facilitate axial stretching to release the detent and rotation to adjust the position of the abutment face.

11 Claims, 4 Drawing Sheets

ADJUSTABLE BUMPER FOR DOOR

FIELD OF THE INVENTION

The present invention relates to an elastomeric bumper mounted on a door frame for adjusting the closed position of a door.

BACKGROUND OF THE INVENTION

Motor vehicles typically have a glove box mounted on the instrument panel and having a hinged door to close the glove box. The instrument panel has an opening defined by a door frame. The door is mounted on hinges that are mounted on the door frame for movement of the door between open and closed positions. A latch is provided between the free end of the door and the door frame to latch the door in the closed position.

It is well known to provide an elastomeric bumper that is mounted on the door frame and becomes engaged by the door when the door reaches the closed position to thereby precisely establish the closed position of the door and assure that the face of the door is precisely flush with the face of the instrument panel.

SUMMARY OF THE INVENTION

A vehicle instrument panel includes a glove box opening defined by a door frame, and a door mounted to the door frame for movement between open and closed positions. A threaded aperture is formed in the door frame. A one-piece elastomeric bumper is provided having a threaded shank that threads into the threaded aperture to mount the bumper. The bumper also has an abutment face that becomes engaged by the door to establish the closed position of the door. Rotation of the threaded bumper will advance or withdraw the abutment face so that the closed position of the door can be adjusted. A detent is provided that acts between the door frame and the bumper to normally retain the bumper at a selected rotary position. The detent is released when the threaded shank of the bumper is stretched axially. A grip is molded into the bumper to facilitate the simultaneous axial stretching to release the detent and rotation to adjust the position of the abutment face.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application. The glove box may be an open topped box that is carried on the inside of the hinged door to swing with the door.

Figure 1:
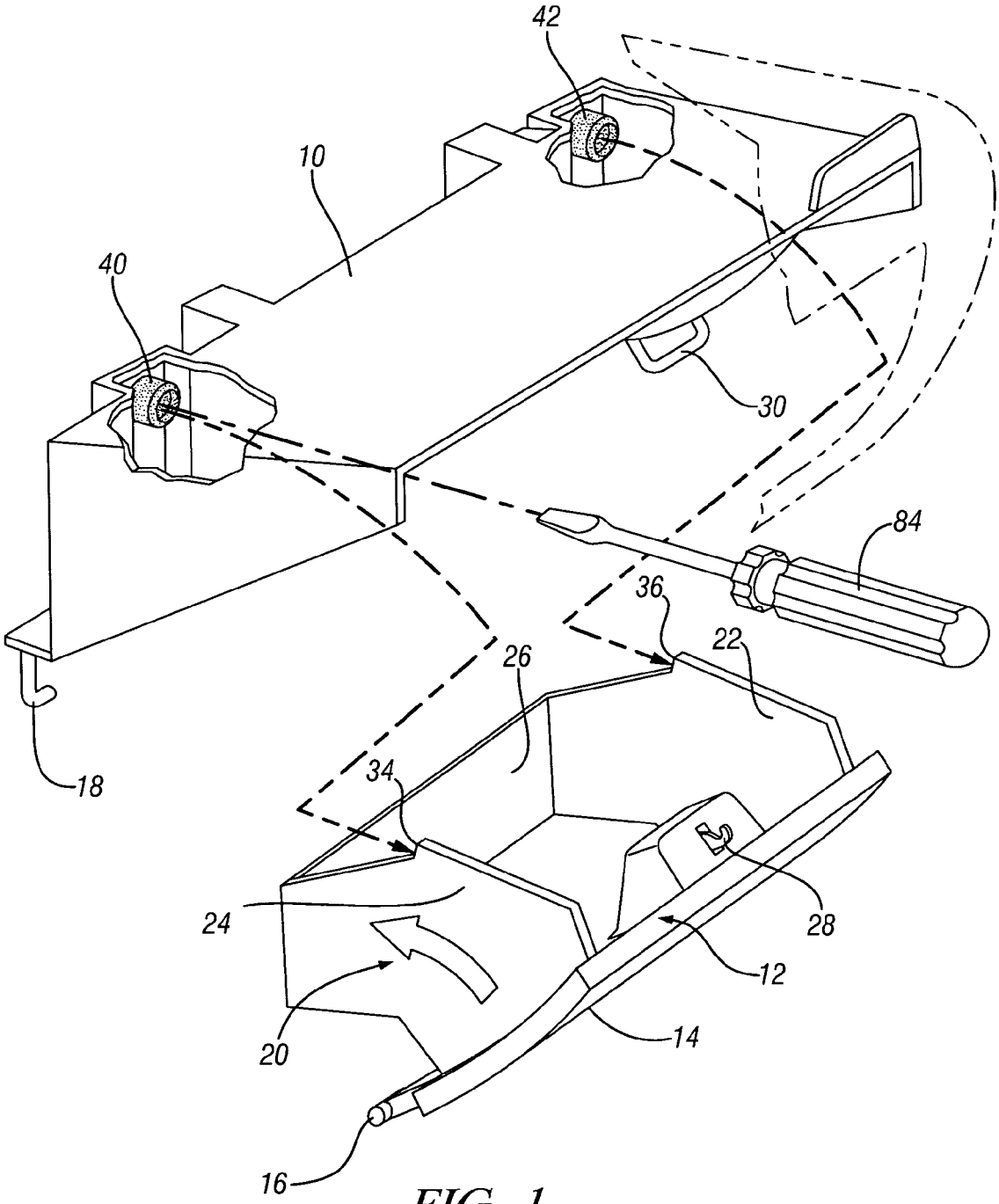
FIG. 1 is a perspective exploded view of a vehicle glove box.

Referring to FIG. 1, a portion of a vehicle instrument panel is shown, including a door frame 10 and a glove box door 12. The door 12 include a door face panel 14 having a hinge pin 16 located at the bottom edge thereof and adapted to engage with a hinge socket 18 located on the door frame, so that the door 12 is hingedly mounted for swinging movement between open and closed positions. As seen in FIG. 1, an open topped bucket, formed by laterally spaced apart side walls 22 and 24, and a rear wall 26 is carried on the inside of the door 12. This open topped bucket defines a glove box that is open and accessible when the door is swung open, and closed and inaccessible when the door 12 is swung to a closed position. The door 12 carries a door latch 28 that will engage with a striker 30 mounted on the door frame 10 to latch the door 12 in the closed position.

The closed position of the door 12 is established by a pair of abutment surfaces 34 and 36 that will be carried into respective engagement with mating elastomeric bumpers 40 and 42 mounted on the door frame 10.

Figure 2:
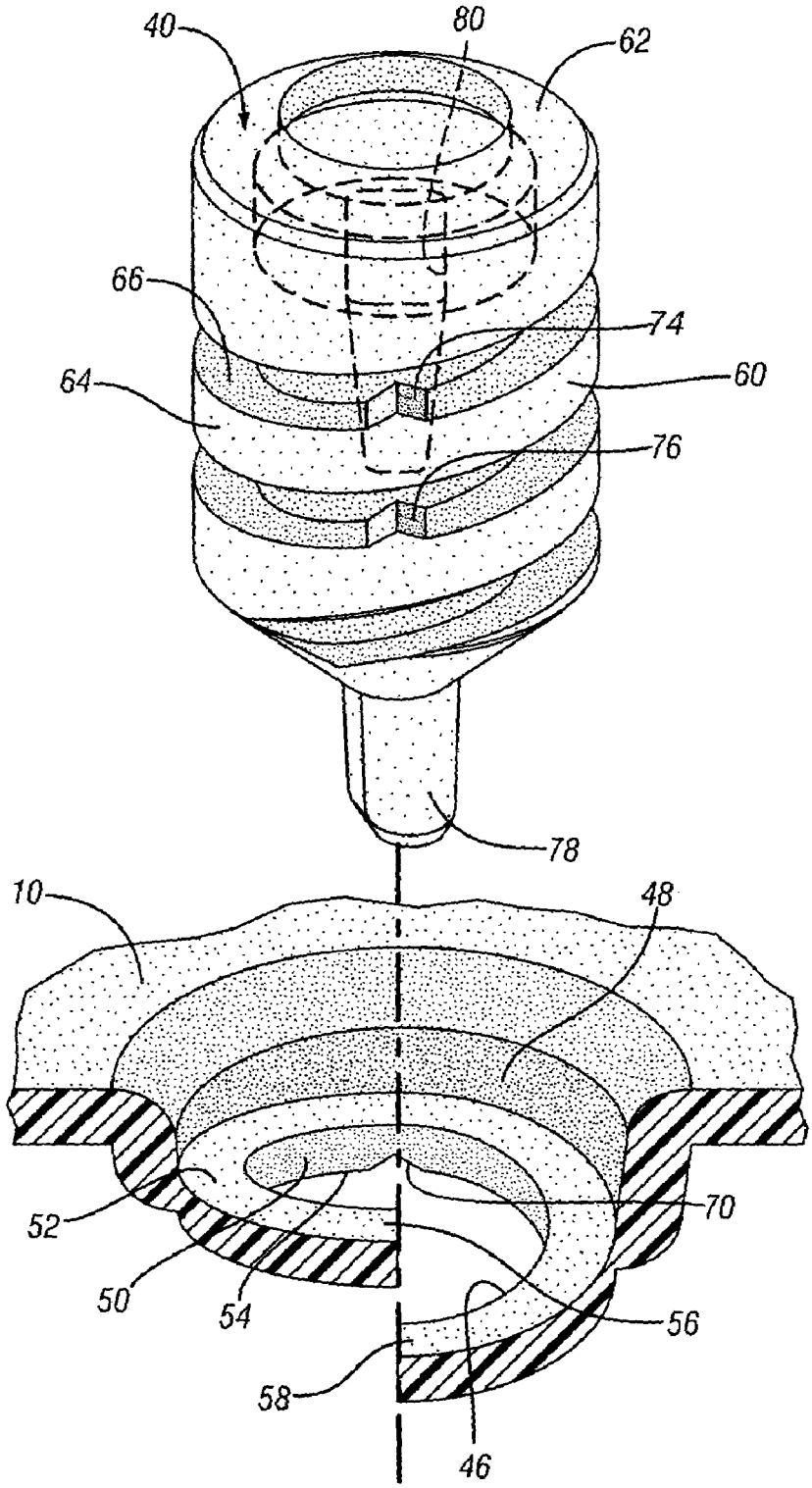
FIG. 2 is a perspective view showing a bumper and a door frame.

Referring to FIG. 2, it is seen that the door frame 10 is of stamped sheet metal or molded plastic construction and includes a threaded aperture 46 seated in a recess 48 formed in the door frame 10. As seen in FIG. 2, the threaded aperture 46 is defined by a spiraling wall 50 including an upper face 52 and lower face 54. The spiraling wall ends at an upper end 56 and a lower end 58, so as to provide a thread of a single spiral.

FIG. 2 also shows the elastomeric bumper 40, which is comprised generally of a threaded shank 60 and an abutment face 62. The elastomeric bumper 40 is molded of a relatively soft and resilient elastomeric material and includes an integrally formed thread 64 defined by a groove 66 that spirals several times around the circumference of the threaded shank 60. The lowermost end of the groove 66 is adapted to be threaded into the threaded aperture 46 of the door frame 10 to an installed position shown in FIG. 5A. When the bumper is so installed, the abutment face 62 faces toward the abutment shoulder 34 of the door 12.

Figure 3:
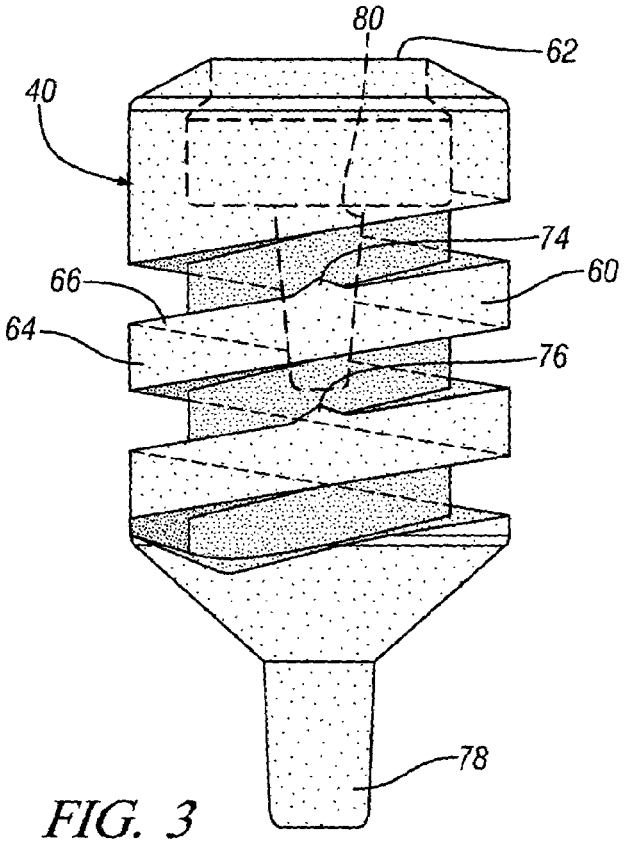
FIG. 3 is a side elevation view of the bumper.
Figure 4:
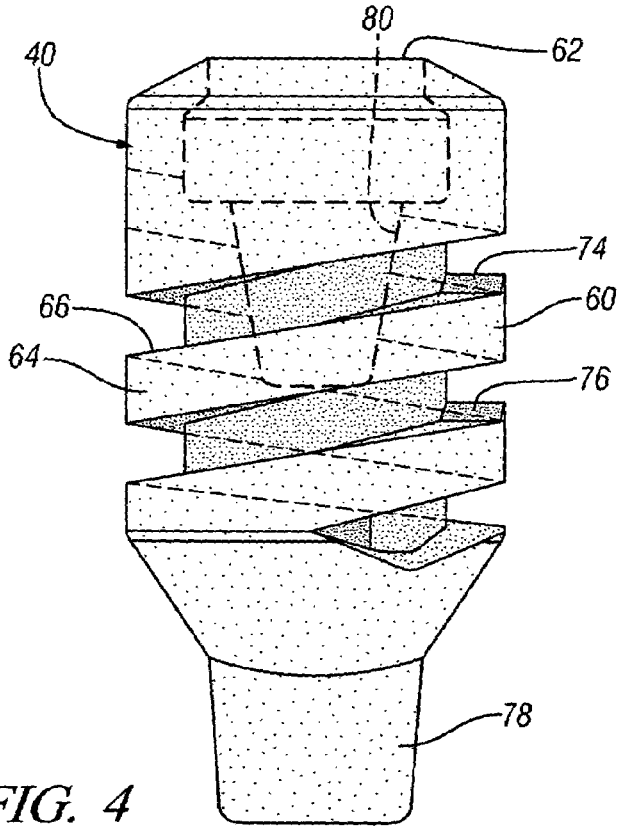
FIG. 4 shows the bumper of FIG. 3 rotated 90 degrees.

Referring again to FIGS. 2 and 3, it will be seen that a detent is provided between the bumper 40 and the threaded aperture 46 of the door frame 10 to retain the bumper 40 at selected rotary positions. As best seen in FIG. 2, the door frame 10 has a notch 70 that is formed in the lower face 54 of the spiraling wall 50. FIG. 2 also shows that elastomeric bumper 40 has a projection 74 and a projection 76 that project upwardly into the groove 66. The projections 74 and 76 are provided on adjacent spirals of the groove 66.

Figure 5A:
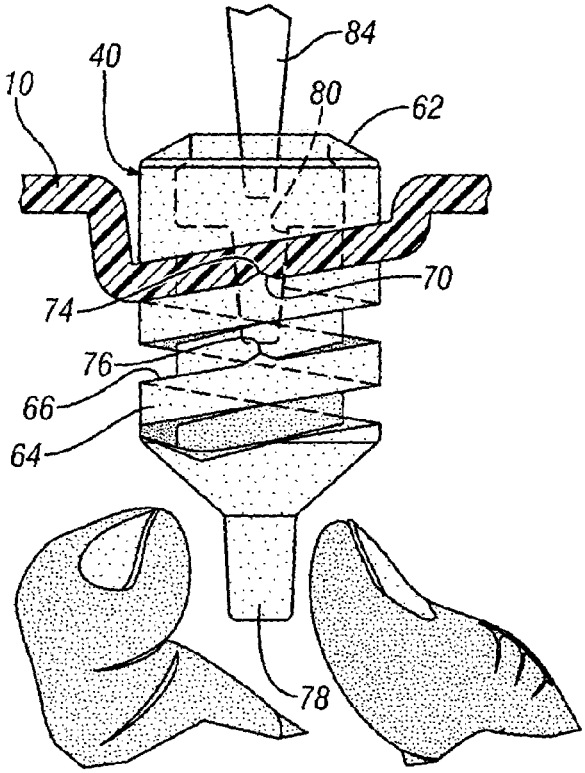
FIG. 5A is a side elevation view showing the bumper installed in the door frame.
Figure 5B:
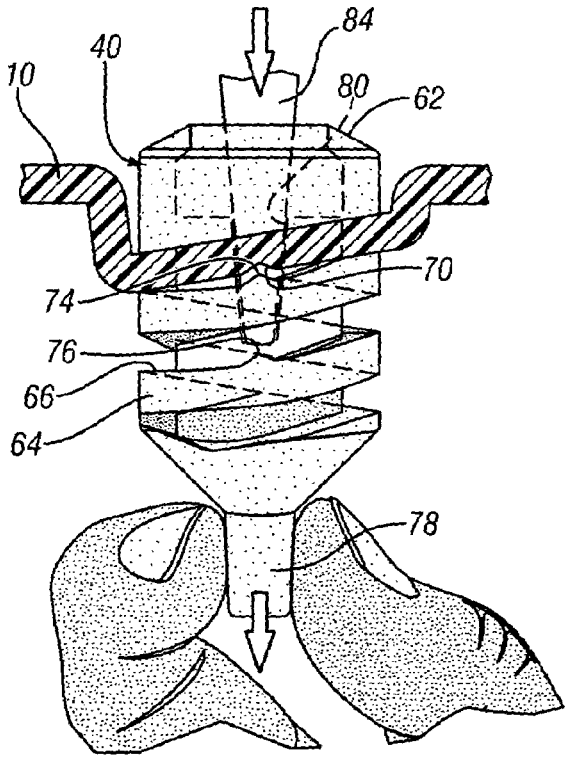
FIG. 5B is a side elevation view similar to FIG. 5A but showing the bumper being stretched axially to enable rotation of the bumper.

Referring to FIG. 5A, it is seen that the projection 74 of the bumper 40 is seated in the notch 70, to thereby cooperate in forming a detent that retains the bumper in the rotary position of FIG. 5A. Referring to FIG. 5B, it is seen that stretching the bumper 40 lengthwise in the axial direction will disengage the projection 74 from the notch 70 so that the bumper 40 may be rotated.

As best seen in FIG. 5B, the lowermost end of the threaded shank 60 has a finger grip 78 by which the user may grip the bumper 40 to stretch the bumper to release the detent formed by the engagement of the projection 74 within the notch 70, and then also rotate the bumper 40 so that abutment face 62 of the bumper will be withdrawn or advanced in position to thereby adjust the closed position of the glove box door relative to the instrument panel of the vehicle.

FIGS. 5A and 5B also show that the bumper 40 has a screwdriver slot 80 that is molded in the abutment face 62 and descends into the threaded shank 60. Thus the user may insert a screwdriver 84 into the screwdriver slot 80, and by pushing on the screwdriver 84, the threaded shank 60 is stretched axially to disengage the detent. Then the bumper 40 can be rotated to thereby withdraw or advance the position of the bumper to adjust the closed position of the door. Thus it will be appreciated the user may choose to release the detent and adjust the bumper via either the use of the finger grip 78 or by use of the screw driver slot 80 and screwdriver 84.

It will also be appreciated that one complete rotation of the bumper from the rotary position shown in FIG. 5A will cause projection 74 of the threaded shank to have passed beyond the upper end 56 of the spiraling wall 50 and cause the projection 76 to become aligned with the notch 70. Thus when the axial force is relieve from the threaded shank, by either releasing the screwdriver 84 or the finger grip 78, the threaded shank will contract and thereby cause the detent to once again become engaged via the seating of the projection 76 in the notch 70.

It will be understood that the adjustability of the bumper will be determined by several variables in the design of the bumper. The threads of the threaded shank have a pitch, angle and number of spirals that are selected to provide the desired degree of axial movement of the bumper face per revolution of the bumper. An example of a practical threaded shank is one in which the threads are spaced at a pitch of 3 millimeters along the shank, so that one rotation of the bumper will cause the bumper abutment face 62 to move axially 3 millimeters, and thereby achieve an adjustment of 3 millimeters in the closed position of the glove box door. However, it will also be understood that although the drawings show only a single notch 70, it may be desirable to have two or three or more notches spaced around the circumference of the lower face 54 of the spiraling wall 50 of door frame 10 so that the detent may be reengaged at lesser degrees of rotation, thereby proving finer adjustments of the bumper and the glove box door. The adjustable bumper of this description may also be mounted to the door and act against a fixed, smooth surface on door frame 10. Thus, it would provide all of the features described herein, mounted in that manner.

The foregoing description of the invention is merely exemplary in nature and, thus, variations that do not depart from the gist of the invention are intended to be within the scope of the invention. Although FIG. 1 shows a glove box of the type having a bucket mounted noted on the inside of the door, it will be understood that the bumper of this invention is also useful in glove boxes of the type where the glove box is an open sided box that is mounted on the instrument panel. Such variations are not to be regarded as a departure from the spirit and scope of the invention. Indeed, the adjustable bumper of this invention is not limited to use with vehicle glove box doors, but may used in conjunction with other doors where it is desirable and useful to employ an adjustable stop.

What is claimed is:

1. A device for establishing the closed position of a door hingedly mounted on a door frame for movement between open and closed positions, comprising:

a threaded aperture formed in the door frame;

a one-piece molded elastomeric bumper including a threaded shank for threaded mounting the bumper in the threaded aperture of the door frame and an abutment face for engagement by the door to establish the closed position of the door; whereby rotation of the bumper induces axial movement of the bumper and its abutment face to adjust the closed position of the door;

a grip molded with the bumper and by which the bumper is simultaneously stretched about its axis and rotated into and out of the threaded aperture to thereby adjust the position of the bumper;

and a detent acting between the door frame and the bumper to normally retain the bumper at a rotary position, and said detent being disengaged when the bumper is stretched axially to enable the rotation of the bumper.

2. The device of claim 1 in which the grip is a finger grip molded integrally with the bumper.

3. The device of claim 2 in which the finger grip enables axial stretching of the bumper about its axis to release the detent, and then rotation of the bumper to a selected rotary position thereby adjusting the closed position of the door.

4. The device of claim 1 in which the grip is a screwdriver slot molded integrally with the bumper.

5. The device of claim 1 in which the grip includes both a finger grip molded integrally with the bumper and a screw driver slot molded in the abutment face so that the bumper is capable of being stretched and rotated by the choice of either the user's fingers or a screw driver.

6. The device of claim 5 in which the threaded shank has a spiraling thread and a plurality of projections extend from the surface of the spiraling thread and are progressively engaged within a notch formed on the door frame to thereby detent the bumper at selected degrees of rotation of the bumper.

7. The device of claim 1 in which the detent is comprised of a projection extending from the bumper and seated within a mating notch formed in the door frame, said axial stretching of the bumper causing the projection to become unseated from the notch so that the bumper may be rotated.

8. A device for establishing the closed position of a door hingedly mounted on a door frame for movement between open and closed positions, comprising:

a threaded aperture formed in the door frame and having a spiral surface forming a thread;

a one-piece molded elastomeric bumper including a threaded shank having a spiral surface forming a thread for mounting the bumper in the threaded aperture of the door frame and an abutment face for engagement by the door to establish the closed position of the door;

a screwdriver slot molded in the abutment face of the bumper and adapted to receive a screwdriver by which the bumper is stretched about its axis and rotated into and out of the threaded aperture to thereby adjust the axial position of the location of the abutment face of the bumper;

and a detent acting between the door frame and the bumper to normally retain the bumper at a rotary position, said detent including a notch formed on the underside of the door frame on the spiral surface forming the thread of the threaded aperture and a mating projection formed on the spiral surface of the thread of the threaded shank, whereby the detent is normally engaged via engagement of the projection in the notch to retain the bumper at a selected position, and whereby upon the insertion of the screwdriver into the screwdriver slot and the imposition of axial insertion of the screw driver the bumper is stretched axially to disengage the detent by releasing the projection from the notch to enable the rotary adjusting movement of the bumper.

9. The device of claim 8 in which a finger grip of non-circular shape is molded on the end of the bumper opposite the screwdriver slot and adapted to be gripped and pulled to axially stretch the bumper and rotated to rotate the bumper.

10. A device for establishing the closed position of a door hingedly mounted on a door frame for movement between open and closed positions, comprising:

a threaded aperture formed in the door frame and having a spiral surface forming a thread;

a one-piece molded elastomeric bumper including a threaded shank having a spiral surface forming a thread for mounting the bumper in the threaded aperture of the door frame and an abutment face for engagement by the door to establish the closed position of the door;

a finger grip molded with the threaded shank at the end thereof opposite the abutment face of the bumper and adapted to be gripped and pulled by which the bumper is stretched about its axis and rotated into and out of the threaded aperture to thereby adjust the axial position of the location of the abutment face of the bumper;

and a detent acting between the door frame and the bumper to normally retain the bumper at a rotary position, said detent including a notch formed on the underside of the door frame on the spiral surface forming the thread of the threaded aperture and a mating projection formed on the spiral surface of the thread of the threaded shank, whereby the detent is normally engaged via engagement of the projection in the notch to retain the bumper at a selected position, and whereby upon axial stretching of the bumper via pulling the finger grip the detent is released by releasing the projection from the notch to enable the rotary adjusting movement of the bumper.

11. The device of claim 10 in which a screwdriver slot of non-circular shape is molded integrally with the bumper at the end thereof opposite the finger grip so that the bumper is axially stretched and then rotated.

* * * * *